US011044552B2

(12) United States Patent
Zheng

(10) Patent No.: US 11,044,552 B2
(45) Date of Patent: Jun. 22, 2021

(54) ACOUSTIC RADIATION CONTROL METHOD AND SYSTEM

(71) Applicant: Jianwen Zheng, Shenzhen (CN)

(72) Inventor: Jianwen Zheng, Shenzhen (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/638,021

(22) PCT Filed: Aug. 31, 2017

(86) PCT No.: PCT/CN2017/099842
§ 371 (c)(1),
(2) Date: Feb. 10, 2020

(87) PCT Pub. No.: WO2019/041213
PCT Pub. Date: Mar. 7, 2019

(65) Prior Publication Data
US 2020/0186917 A1 Jun. 11, 2020

(51) Int. Cl.
*H04R 1/40* (2006.01)
*H04R 3/12* (2006.01)
(Continued)

(52) U.S. Cl.
CPC ..... *H04R 1/403* (2013.01); *H04R 3/12* (2013.01); *H04R 5/02* (2013.01); *H04R 5/04* (2013.01);
(Continued)

(58) Field of Classification Search
CPC .... H04R 1/403; H04R 25/402; H04R 25/405; H04R 1/32; H04R 1/323; H04R 3/12;
(Continued)

(56) References Cited

U.S. PATENT DOCUMENTS 9,313,600 B2 4/2016 Choi et al.
2006/0147057 A1* 7/2006 Aggarwal ..... H04S 7/301 381/103
2011/0081023 A1* 4/2011 Raghuvanshi ..... H04S 7/30 381/17

FOREIGN PATENT DOCUMENTS

CN 101682806 A 3/2010
WO 2011144499 A1 11/2011
WO 2017063688 A1 4/2017

OTHER PUBLICATIONS

Diemer de Vries ("Sound Enhancement by Wave Field synthesis: Adaptation of the Synthesis Operator to the Loudspeaker Directivity Characteristics", AES, the 98th Convention Feb. 25-28, 1995, Paris French, p. 1-7. (Year: 1995).*

(Continued)

*Primary Examiner* — Leshui Zhang
(74) *Attorney, Agent, or Firm* — Angela M. Brunetti

(57) ABSTRACT

Acoustic radiation control method and system are provided. The acoustic radiation control method includes: configuring a speaker array; obtaining transfer functions of speakers in the speaker array based on configuration of the speaker array and directivity of the speakers; obtaining, based on the transfer functions of the speakers, source strength of the speakers which enables acoustic radiation of the speaker array in a first zone greater than acoustic radiation of the speaker array in a second zone; and applying the source strength of the speakers to the speaker array. By the method, acoustic radiation may be controlled more accurately, a sidelobe level may be constrained more effectively, and the number of speakers in the speaker array may be reduced.

16 Claims, 8 Drawing Sheets

(51) Int. Cl.
*H04R 5/02* (2006.01)
*H04R 5/04* (2006.01)
*H04S 7/00* (2006.01)

(52) U.S. Cl.
CPC ..... *H04S 7/302* (2013.01); *H04R 2430/20* (2013.01); *H04S 2420/01* (2013.01)

(58) Field of Classification Search
CPC ..... H04R 3/14; H04R 25/407; H04R 5/02; H04R 5/04; H04R 2430/20; H04R 2430/21; H04R 2430/23; H04R 2430/25; H04R 2201/025; H04S 7/301; H04S 7/302; H04S 7/303; H04S 2420/01; H04S 2420/13; G10K 15/02
USPC ..... 381/56, 58, 59, 60, 61, 300, 302, 303, 381/304, 305, 308, 309, 310, 77, 79, 80, 381/81, 86, 89, 332, 111, 116, 117; 700/94
See application file for complete search history.

(56) References Cited

OTHER PUBLICATIONS

Shen Yong et al., Analysis of loudspeaker line array, Loudspeaker and Microphone, Dec. 31, 2014.
Tu Zhen et al., Investigation on the robustness of acoustic focusing algorithm using small-scale loudspeaker array under scattering condition, Journal of Nanjing University (Natural Sciences) Mar. 31, 2016, No. 2 vol. 52 pp. 382 and 384-385.
Tu Zhen et al: "Robustness of a compact endfire personal audio system against scattering effects (L)", The Journal of the Acoustical Society of America, American Institute of Physics for the Acoustical Society of America, New York, NY, US, vol. 140, No. 4, Oct. 17, 2016, pp. 2720-2724, XP012212729, ISSN: 0001-4966, DOI: 10.1121/1.4964752 [retrieved on Oct. 17, 2016].

* cited by examiner

ACOUSTIC RADIATION CONTROL METHOD AND SYSTEM

FIELD

One or more embodiments herein generally relates to acoustic radiation control method and system.

BACKGROUND

Nowadays, sound bar systems are widely used to present listening surround experience. Some sound bar designs adopt Head Related Transfer Function (HRTF) algorithm based on psychoacoustic theory, to generate virtual surround sound effect. Some sound bar designs adopt Delay and Sum methods to enhance listening surround experience. These methods take no account of directivity of speakers, and are hard to restrain a sidelobe level. Besides, some existing sound bar systems require a great number of speakers, and have a relatively narrow sweet spot.

SUMMARY

In an embodiment, an acoustic radiation control method is provided, including: configuring a speaker array; obtaining transfer functions of speakers in the speaker array based on configuration of the speaker array and directivity of the speakers; obtaining, based on the transfer functions of the speakers, source strength of the speakers which enables acoustic radiation of the speaker array in a first zone greater than acoustic radiation of the speaker array in a second zone; and applying the source strength of the speakers to the speaker array.

In some embodiments, the configuration of the speaker array may include a number of the speakers in the speaker array, a facing direction of the speakers in the speaker array and spacing between adjacent speakers in the speaker array.

In some embodiments, obtaining transfer functions of speakers in the speaker array based on configuration of the speaker array and directivity of the speakers may include: calculating an original transfer function of each speaker in the speaker array; measuring directivity of each speaker in the speaker array, wherein the directivity of the speaker represents acoustic radiation of the speaker at different optimized positions; and obtaining a product of the original transfer function and the directivity of each speaker as the transfer functions of the speakers.

In some embodiments, the original transfer functions of the speakers and the directivity of the speakers may be determined based on the configuration of the speaker array.

In some embodiments, the original transfer functions of the speakers and the directivity of the speakers may be determined further based on frequency of an input audio source provided to the speaker array.

In some embodiments, the transfer function of each speaker in the speaker array may be calculated based on Equation (1), $$H_D(r_n) = \frac{e^{-jk|r|}}{|r|} D(\theta, k), \qquad \text{Equation (1)}$$

where $$\frac{e^{-jk|r|}}{|r|}$$

is an original transfer function of the $n^{th}$ speaker in the speaker array, D (θ, k) is the directivity of the $n^{th}$ speaker at wave number k, k=2πf/c, f is frequency of an input audio source, c is speed of sound, r is a vector representing a position relation between an optimized position and a center of the $n^{th}$ speaker, and θ is an angle between a direction from a center of the $n^{th}$ speaker to the optimized position and a facing direction of the $n^{th}$ speaker.

In some embodiments, transfer functions of speakers in the speaker array may be obtained by an anechoic chamber test.

In some embodiments, the source strength of the speakers obtained based on the transfer functions of the speakers may maximize a ratio of acoustic radiation of the speaker array in the first zone to acoustic radiation of the speaker array in the second zone.

In some embodiments, the source strength of the speakers may be obtained using an acoustic contrast control method based on the transfer functions of the speakers.

In some embodiments, applying the source strength of the speakers to the speaker array may include: performing the inverse Fourier transform to the source strength of the speakers to obtain coefficients of a Finite Impulse Response (FIR) filter, wherein the FIR filter is applied to an input audio source provided to the speaker array.

In an embodiment, an acoustic radiation control system is provided, including: a speaker array; and a processing device configured to: obtain transfer functions of speakers in the speaker array based on configuration of the speaker array and directivity of the speakers; obtain, based on the transfer functions of the speakers, source strength of the speakers which enables acoustic radiation of the speaker array in a first zone greater than acoustic radiation of the speaker array in a second zone; and apply the source strength of the speakers to the speaker array.

In some embodiments, the configuration of the speaker array may include a number of the speakers in the speaker array, a facing direction of the speakers in the speaker array and spacing between adjacent speakers in the speaker array.

In some embodiments, the processing device may be configured to: calculate an original transfer function of each speaker in the speaker array; measure directivity of each speaker in the speaker array, wherein the directivity of the speaker represents acoustic radiation of the speaker at different optimized positions; and obtain a product of the original transfer function and the directivity of each speaker as the transfer functions of the speakers.

In some embodiments, the processing device may be configured to determine the original transfer functions of the speakers and the directivity of the speakers based on the configuration of the speaker array.

In some embodiments, the processing device may be configured to determine the original transfer functions of the speakers and the directivity of the speakers further based on frequency of an input audio source provided to the speaker array.

In some embodiments, the processing device may be configured to calculate the transfer function of each speaker in the speaker array based on Equation (1), $$H_D(r_n) = \frac{e^{-jk|r|}}{|r|} D(\theta, k), \qquad \text{Equation (1)}$$

where $$\frac{e^{-jk|r|}}{|r|}$$

is an original transfer function of the $n^{th}$ speaker in the speaker array, D (θ, k) is the directivity of the $n^{th}$ speaker at wave number k, k=2πf/c, f is frequency of an input audio source, c is speed of sound, r is a vector representing a position relation between an optimized position and a center of the $n^{th}$ speaker, and θ is an angle between a direction from a center of the $n^{th}$ speaker to the optimized position and a facing direction of the $n^{th}$ speaker.

In some embodiments, transfer functions of speakers in the speaker array may be obtained by an anechoic chamber test.

In some embodiments, the source strength of the speakers obtained by the processing device based on the transfer functions of the speakers may maximize a ratio of acoustic radiation of the speaker array in the first zone to acoustic radiation of the speaker array in the second zone.

In some embodiments, the processing device may be configured to obtain the source strength of the speakers using an acoustic contrast control method based on the transfer functions of the speakers.

In some embodiments, the processing device may be configured to perform the inverse Fourier transform to the source strength of the speakers to obtain coefficients of a FIR filter, wherein the FIR filter is applied to an input audio source provided to the speaker array.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF EMBODIMENTS

Figure 1:
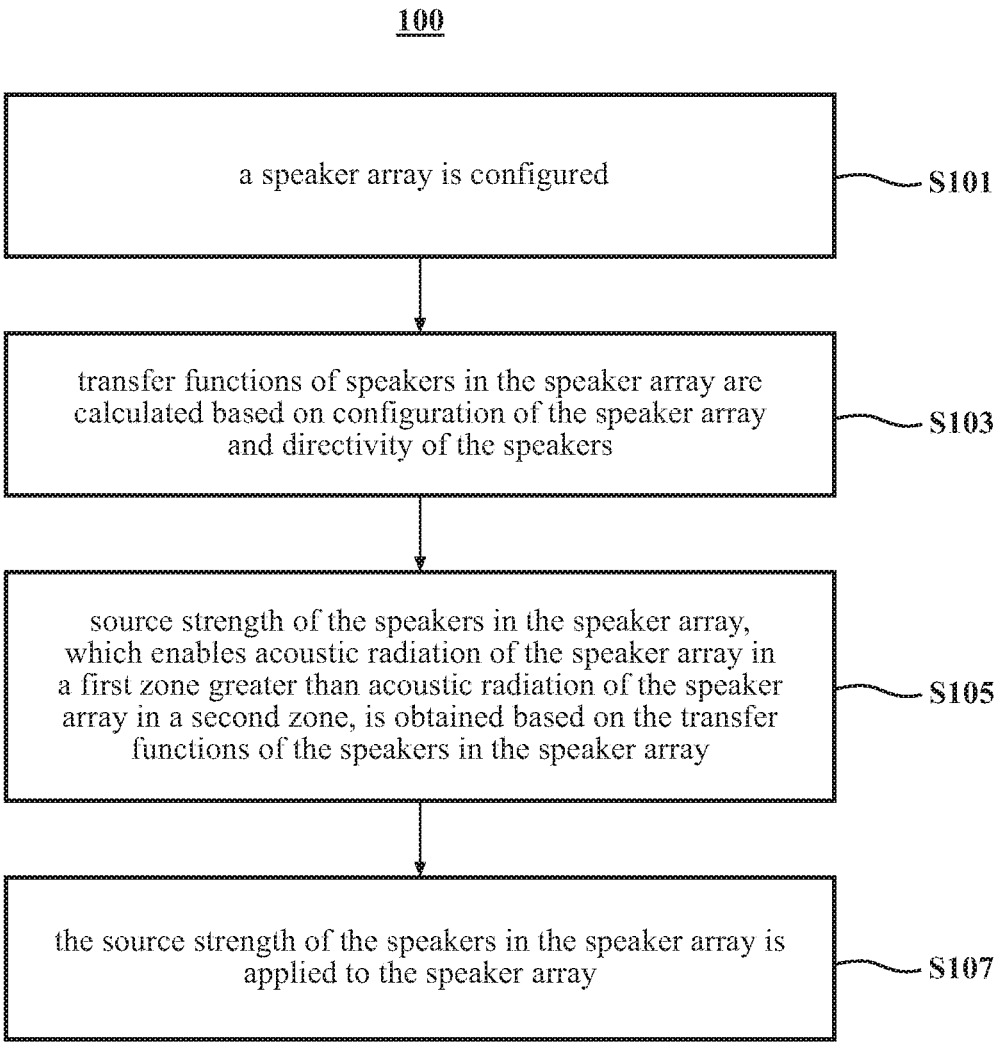
FIG. 1 is a flow chart of an acoustic radiation control method according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

To enhance listening surround experience, beamforming technology is used to control main directions of acoustic radiation. When the main directions point towards sides, a sound field is expanded. To obtain better surround experience, a mainlobe level should be maximized, and a sidelobe level should be minimized. Moreover, orientation of speakers in a speaker array affects performance of the speaker array. Therefore, in acoustic radiation control in embodiments, directivity of the speakers is taken into consideration, to provide better performance of the speaker array.

FIG. 1 is a flow chart of an acoustic radiation control method 100 according to an embodiment.

Referring to FIG. 1, in S101, a speaker array is configured.

In some embodiments, the speaker array may include at least two speakers. In some embodiments, the speakers may be arranged in line.

Figure 2:
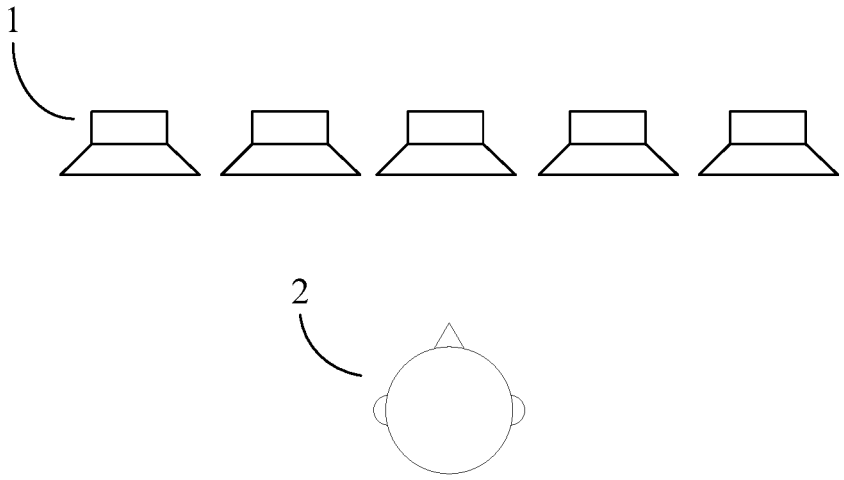
FIG. 2 is a diagram of a speaker array according to an embodiment.
Figure 3:
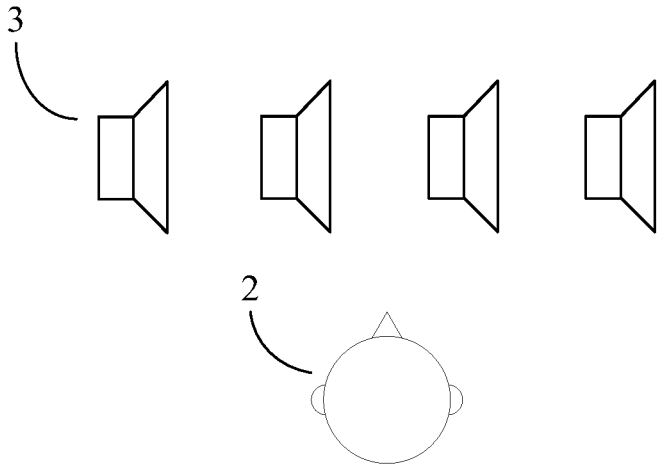
FIG. 3 is a diagram of a speaker array according to another embodiment.

For example, referring to FIG. 2, the speaker array 1 includes five speakers disposed facing a listener 2. In some embodiments, the speaker array may include other number of speakers, and the speakers may be disposed facing other directions. For example, referring to FIG. 3, the speaker array 3 includes four speakers disposed facing a right side. In some embodiments, speakers in the speaker array may be disposed towards different directions, for example, some facing a listener and some facing a side.

Configuration of the speaker array further includes a spacing between adjacent speakers in the speaker array. A sound bar with the speaker array generally has a compact structure. In some embodiments, the spacing between adjacent speakers in the speaker array may be within a range from 20 mm to 200 mm, for example, 30 mm, 40 mm, 50 mm, 60 mm or 70 mm.

It should be noted that, the configuration of the speaker array is not limited to the above embodiments.

Based on the configuration of the speaker array, some characteristics of the speaker array may be determined. For example, a transfer function is used to describe input-output characteristic of the speaker array.

Referring to FIG. 1, in S103, transfer functions of speakers in the speak array are calculated based on configuration of the speaker array and directivity of the speakers.

As described above, orientation of speakers in the speaker array affects performance of the speaker array. Therefore, in some embodiments, to control acoustic radiation of the speaker array more accurately, the directivity of the speakers is considered in the calculation of the transfer functions.

Figure 4:
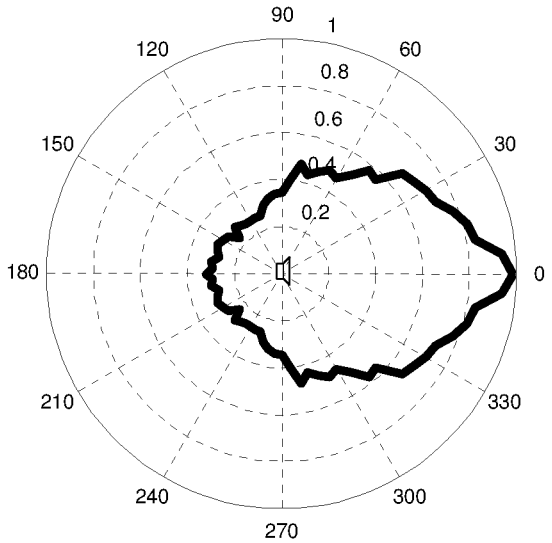
FIG. 4 is a diagram illustrating a measurement result of average directivity of one speaker in a speaker array at a frequency range from 500 Hz to 3 kHz.

FIG. 4 is a diagram illustrating a measurement result of average directivity of one speaker in the speaker array at a frequency range from 500 Hz to 3 kHz, which shows acoustic radiation of the speaker in different directions relative to the speaker. 0° represents front of the speaker, 90° and 270° represent two sides of the speaker, and 180° represents back of the speaker. It can be seen from FIG. 4 that acoustic radiation reaches maximum at 0°, and gradually decreases from two sides of 0°, and different directions correspond to different acoustic radiation. Therefore, in embodiments, the directivity of the speakers is considered in the calculation of the transfer functions of the speakers.

In some embodiments, a product of an original transfer function of the speaker and the directivity of the speaker may serve as the transfer function of the speaker. The original transfer function means a general free-field transfer function without consideration of the directivity of the speaker.

In some embodiments, the transfer function of each speaker in the speaker array may be calculated based on Equation (1), $$H_D(r_n) = \frac{e^{-jk|r|}}{|r|} D(\theta, k), \qquad \text{Equation (1)}$$

where $$\frac{e^{-jk|r|}}{|r|}$$

is an original transfer function of the $n^{th}$ speaker in the speaker array, D (θ, k) is the directivity of the $n^{th}$ speaker at wave number k, k=2πf/c, f is frequency of an input audio source, c is speed of sound, r is a vector representing a position relation between an optimized position and a center of the $n^{th}$ speaker, and θ is an angle between a direction from a center of the $n^{th}$ speaker to the optimized position and a facing direction of the $n^{th}$ speaker.

It can be seen that, both the original transfer functions of the speakers and the directivity of the speakers are determined based on the configuration of the speaker array (including the number of speakers in the speaker array, the facing directions of the speakers, the spacing between adjacent speakers and so on) and the optimized positions. Besides, the original transfer functions of the speakers and the directivity of the speakers are determined further based on frequency of the input audio source.

Figure 5:
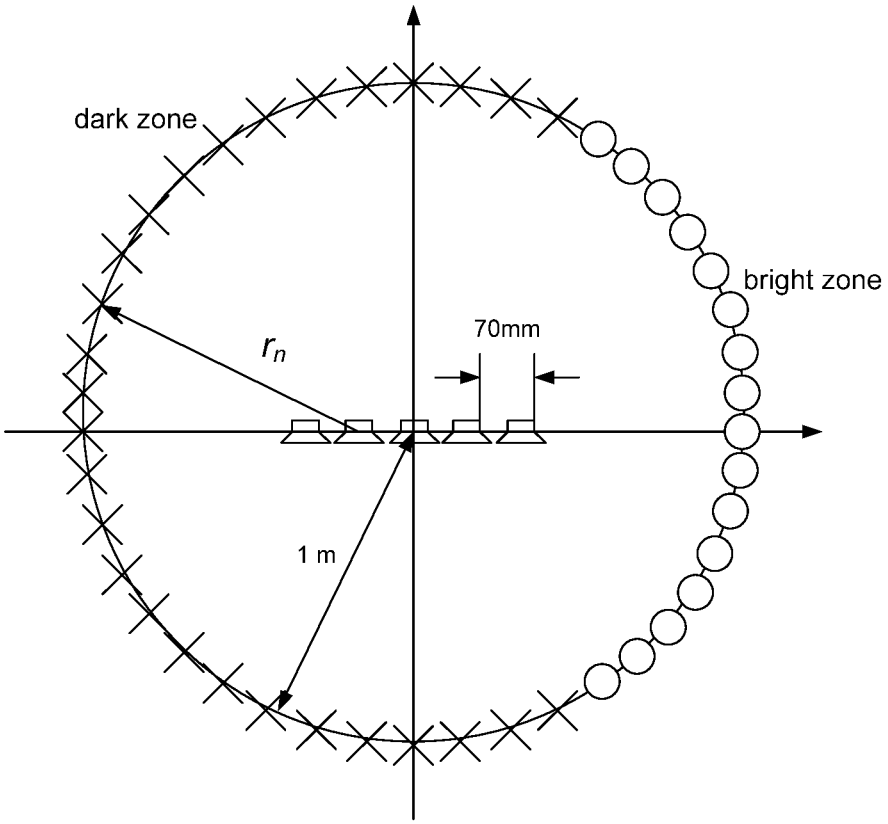
FIG. 5 is a diagram illustrating configuration of a speaker array.

Referring to FIG. 5, five speakers in the speaker array are disposed forward with a spacing of 70 mm between adjacent speakers. The optimized positions are located at a circle with a radius of 1 m with respect to the center of the speaker array. $r_n$ in FIG. 5 represents a position relation between an optimized position and a center of the second speaker.

Optionally, in some embodiments, the transfer functions of speakers in the speaker array may be directly obtained by an anechoic chamber test.

Referring to FIG. 1, in S105, source strength of the speakers in the speaker array, which enables acoustic radiation of the speaker array in a first zone greater than acoustic radiation of the speaker array in a second zone, is obtained based on the transfer functions of the speakers in the speaker array.

In some embodiments, the source strength of the speakers obtained based on the transfer functions of the speakers may maximize a ratio of acoustic radiation of the speaker array in the first zone to acoustic radiation of the speaker array in the second zone.

As described above, to obtain better listening surround experience, acoustic radiation towards undesired directions (for example, a direction facing a listener) expects to be weakened, and acoustic radiation towards desired directions (for example, directions towards sides of the listener) expects to be strengthened. That is, a mainlobe level should be maximized, and a sidelobe level should be minimized. In some embodiments, an Acoustic Contrast Control (ACC) method is used to make acoustic radiation of the speaker array towards desired directions relatively great and acoustic radiation of the speaker array towards undesired directions relatively small under the configuration in S101. The ACC method can form a largest acoustic contrast between a bright zone and a dark zone, i.e., enabling a maximum ratio of a mainlobe level to a sidelobe level. Acoustic radiation of the speakers can be represented by source strength of the speakers and the transfer functions of the speakers. Therefore, after the speaker array is configured and the transfer functions of the speakers in the speaker array are determined, the source strength of the speakers can determine the acoustic radiation of the speaker array towards different directions.

In some embodiments, the acoustic radiation of the speakers may be represented by sound pressure of the speakers.

In some embodiments, the sound pressure of the speaker array at an optimized position r is represented by Equation (2), $$p(r)=\Sigma_{n=1}^{N} H_D(r_n) q_n \qquad (2),$$

where $H_D(r_n)$ is the transfer function of the $n^{th}$ speaker in the speaker array, $q_n$ is the speaker strength of the $n^{th}$ speaker, and N is the number of the speakers in the speaker array.

To maximize the mainlobe level and minimize the sidelobe level, a ratio of the sound pressure in the desired directions to the sound pressure in the undesired direction may be maximized. Still referring to FIG. 5, in the embodiment, a bright zone (i.e., the first zone in S105) represented by 'O' includes the desired directions, and a dark zone (i.e., the second zone in S105) represented by 'X' includes the undesired directions.

The sound pressure in the bright zone is represented by $p(r_b)$, the sound pressure in the dark zone is represented by $p(r_d)$, the transfer function of the $n^{th}$ speaker in the bright zone is represented by $H_b(r_{bn})$, and the transfer function of the $n^{th}$ speaker in the dark zone is represented by $H_d(r_{dn})$. Accordingly, the sound pressure in the bright zone and the dark zone can be rewritten in matrix form as Equation (3), $$p_b=H_{bD}q,\ p_d=H_{dD}q \qquad (3),$$

where $H_{bD}$, $H_{dD}$ and q are matrix forms of the transfer functions of the speakers in the bright zone, the transfer functions of the speakers in the dark zone, and the source strength of the speakers, respectively.

Based on the ACC method, to maximize the ratio of sound pressure in the bright zone to sound pressure in the dark zone, an optimization goal is expressed as Equation (4), $$\max_q\left\{\frac{P_b^H p_b}{P_d^H p_d}\right\} = \max_q\left\{\frac{qH_b^H H_b q}{qH_d^H H_d q}\right\}, \tag{4}$$

where $P_b^H$ is a conjugate matrix of $p_b$, $P_d^H$ is a conjugate matrix of $p_d$, $H_b^H$ is a conjugate matrix of $H_b$, and $H_d^H$ is a conjugate matrix of $H_d$.

Under Equation (4), the source strength q of the speakers is proportional to an eigenvector of the matrix $(H_{dD}^H H_{dD})^{-1}(H_{bD}^H H_{bD})$ which corresponds to its greatest eigenvalue. In some embodiments, the source strength q of the speakers is equal to the eigenvector of the matrix $(H_{dD}^H H_{dD})^{-1}(H_{bD}^H H_{bD})$ which corresponds to its greatest eigenvalue.

Based on Equations (2), (3) and (4), the source strength of the speakers in the speaker array, which maximizes the ratio of sound pressure in the bright zone (i.e., the first zone in S105) to sound pressure in the dark zone (i.e., the second zone in S105), is obtained.

In S107, the source strength of the speakers in the speaker array is applied to the speaker array.

Figure 6:
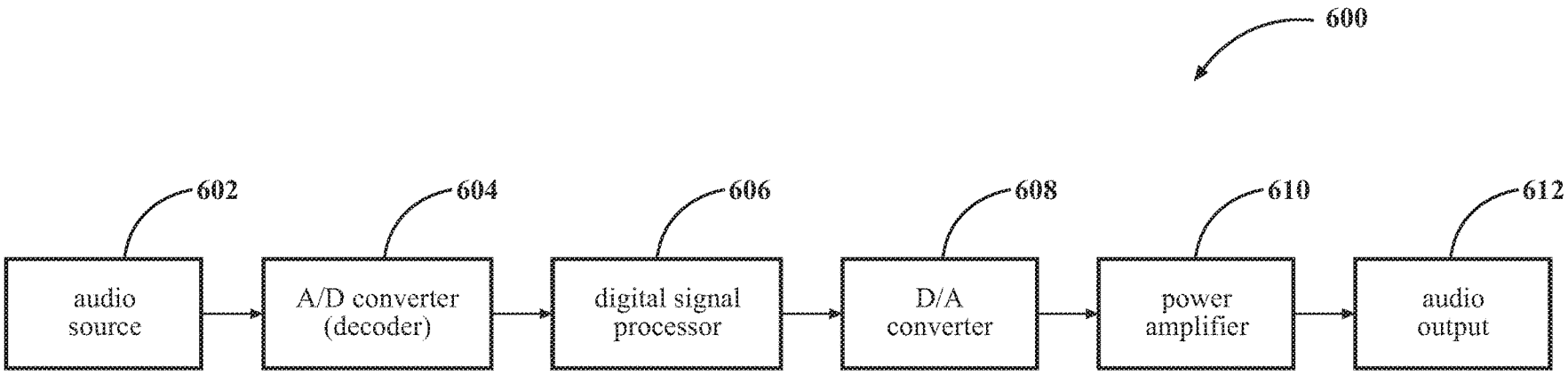
FIG. 6 is a diagram illustrating a process of generating an audio output signal from an audio source according to an embodiment.

FIG. 6 is a diagram illustrating a process 600 of generating an audio output signal 612 from an audio source 602 according to an embodiment. Referring to FIG. 6, the audio source 602 is processed by an A/D converter 604 or a decoder to form digital signals that are capable of being processed by a digital signal processor 606. Afterwards, the digital signals are sent to the digital signal processor (DSP) 606 to be processed. A Finite Impulse Response (FIR) filter is further applied on the DSP 606 to filter processed digital signals. Afterwards, the filtered signals are sent to a D/A converter 608 and a power amplifier 610 successively, to form output analog voltages. In this way, the audio output signal 612 is generated from the audio source 602.

In some embodiments, coefficients of the FIR filter may be obtained by performing the inverse Fourier transform to the source strength of the speakers obtained in S105. That is to say, the source strength of the speakers obtained in S105 is applied to the speaker array. By using the FIR filter with the coefficients corresponding to the source strength obtained in S105, the ratio of sound pressure in the first zone to sound pressure in the second zone may be maximized.

Figure 7:
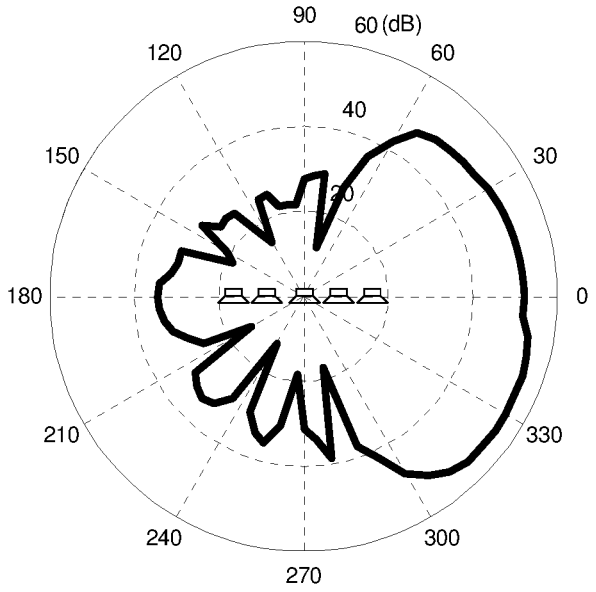
FIG. 7 is a diagram illustrating an exemplary directivity pattern according to an embodiment.

FIG. 7 is a diagram illustrating an exemplary directivity pattern obtained by using the above method 100, where the speaker array includes five speakers disposed facing forward (i.e., facing a listener) with a particular spacing, and the frequency of the audio source is 2 kHz. In FIG. 7, 270° represents front of the speaker, 0° and 180° represent two sides of the speaker, and 90° represents back of the speaker. It can be seen from FIG. 7 that, the acoustic radiation in the bright zone as shown in FIG. 5 is relatively great, while acoustic radiation in the dark zone as shown in FIG. 5 is relatively small.

Figure 8:
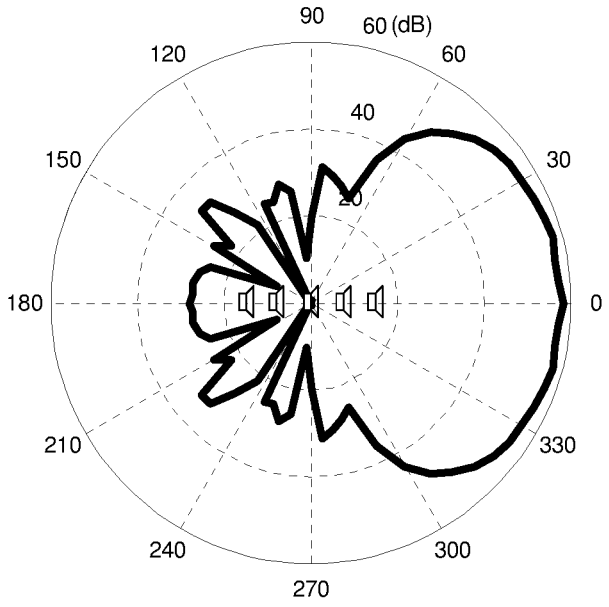
FIG. 8 is a diagram illustrating an exemplary directivity pattern according to another embodiment.

FIG. 8 is a diagram illustrating another exemplary directivity pattern obtained by using the above method 100, where the speaker array includes five speakers disposed facing sideward (i.e., facing one side of a listener) with the same spacing in FIG. 7. Similar with FIG. 7, in FIG. 8, the acoustic radiation in the bright zone as shown in FIG. 5 is relatively great, while acoustic radiation in the dark zone as shown in FIG. 5 is relatively small. Difference between FIGS. 7 and 8 lies in that, a ratio of the acoustic radiation in the bright zone to the acoustic radiation in the dark zone in FIG. 8 is greater than that in FIG. 7, which proves that the directivity of the speakers in the speaker array does affect the acoustic radiation of the speaker array. Therefore, in some embodiments, to obtain better listening surround effect, the speakers in the speaker array may be arranged towards a desired direction, for example, two sides of the listener.

Figure 9:
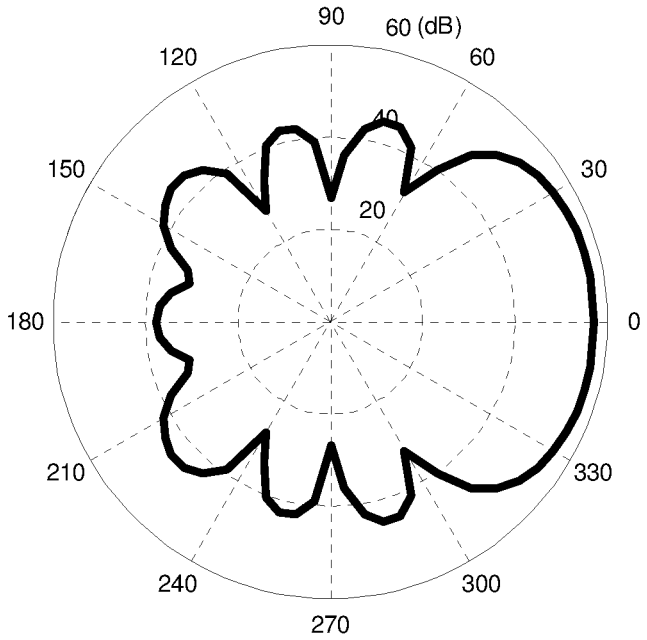
FIG. 9 is a diagram illustrating a directivity pattern obtained by using a Delay and Sum method in existing techniques.

FIG. 9 is a diagram illustrating a directivity pattern obtained by using a Delay and Sum method in existing techniques. As shown in FIG. 9, although a mainlobe level (acoustic radiation within a desired range from 0° to 60° and from 300° to 0°) is relatively great, a sidelobe level (acoustic radiation within an undesired range from 60° to 300°) is also relatively great. That is, the sidelobe level is not well constrained, and thus a ratio of the mainlobe level to the sidelobe level is relatively small. As a result, listening surround effect may not be good as that obtained by the method provided in the above embodiments.

To reduce the number of the speakers in the speaker array, different channels of an audio source may be mixed into the same speakers by using different FIR filters.

Figure 10:
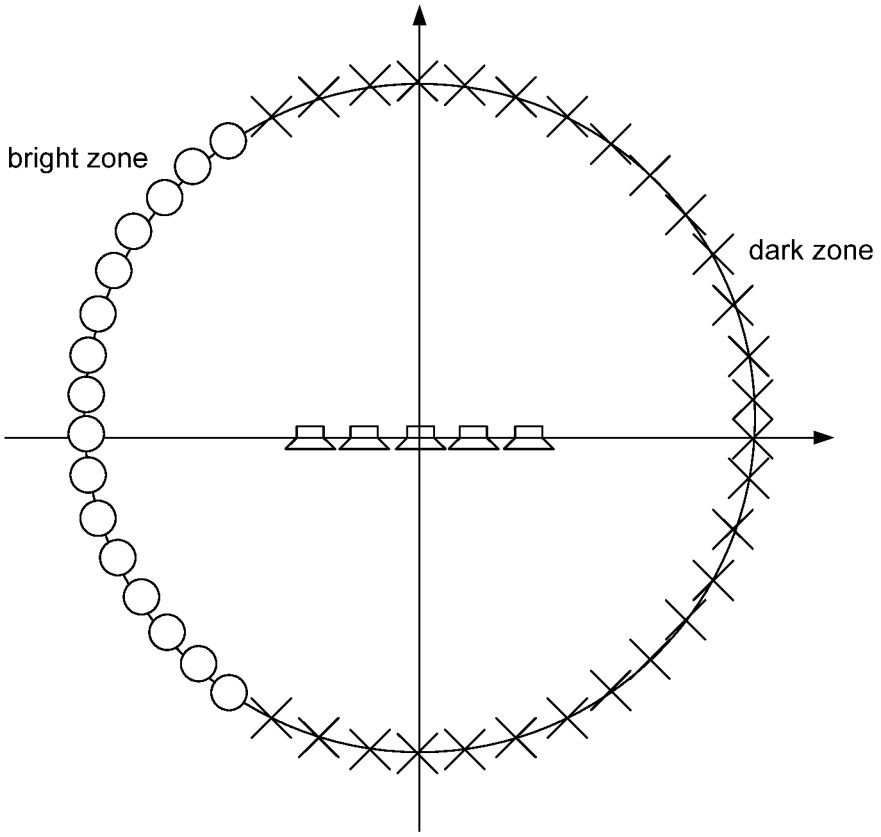
FIG. 10 is a diagram illustrating a bright zone and a dark zone according to an embodiment.

Referring to FIGS. 5 and 7, great acoustic radiation is obtained in the bright zone (a desired range from about 0° to 60° and from about 300° to 0°). Similarly, great acoustic radiation also can be obtained in other desired ranges by using the method 100. For example, referring to FIG. 10, in an embodiment, a desired range from about 120° to about 240° serves as a bright zone which is symmetric to the bright zone in FIG. 5. By using the method 100, great acoustic radiation in the desired range from about 120° to about 240° can be obtained without changing the configuration of the speaker array.

Figure 11:
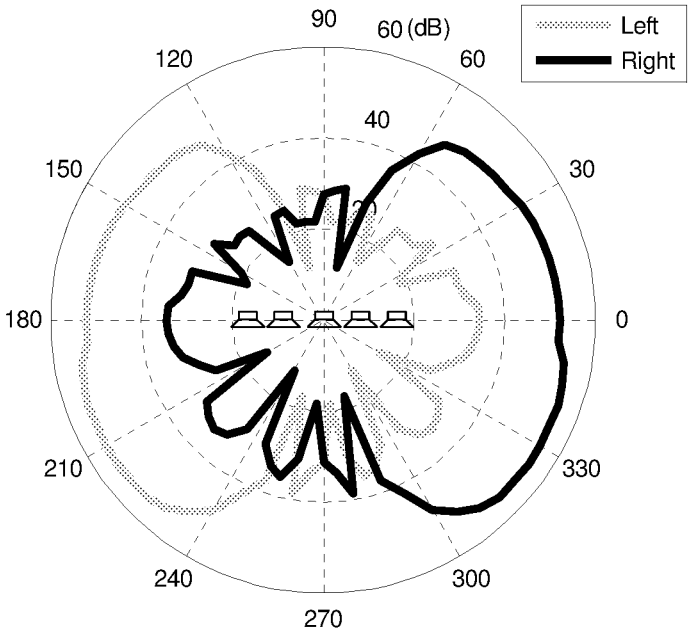
FIG. 11 is a diagram illustrating a directivity pattern obtained by strengthening the acoustic radiation in the bright zones in FIGS. 5 and 10.

FIG. 11 is a diagram illustrating a directivity pattern obtained by strengthening the acoustic radiation in the bright zones in FIGS. 5 and 7 using the above method. It can be seen that, the acoustic radiation at two sides of the speaker array (i.e., two sides of the listener) is enhanced, and the acoustic radiation in other directions is constrained.

Figure 12:
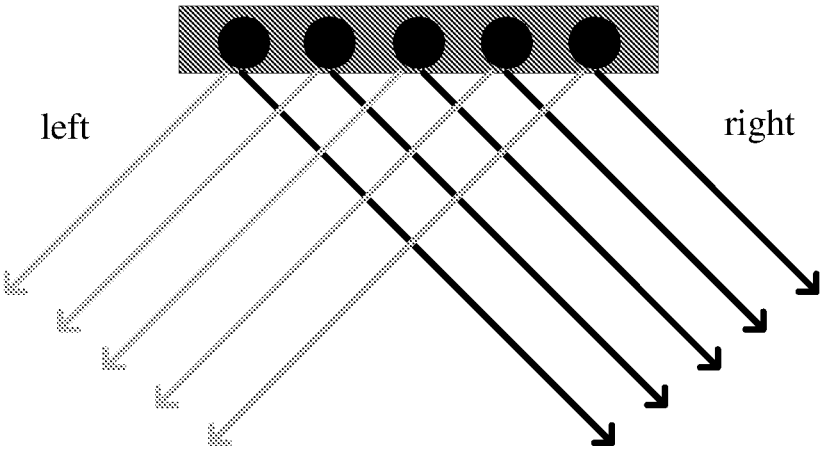
FIG. 12 is a diagram illustrating different beamformers of different channels by using the same speakers according to an embodiment.

In this way, different beamformers of different channels share the same speakers, as illustrated in FIG. 12. Signals of a left channel are reproduced by a first beamformer that focus energy on the left while signals of a right channel are reproduced by a second beamformer that focus the energy on the right, and the two beamformers both make use of the same speaker array. In some applications where the signals of the left and right channels are little relevant, for example, in a movie, the beamformers will work distinctively and the directivity pattern as shown in FIG. 11 may be obtained, which is similar with performance of two independent beamformers.

Figure 13:
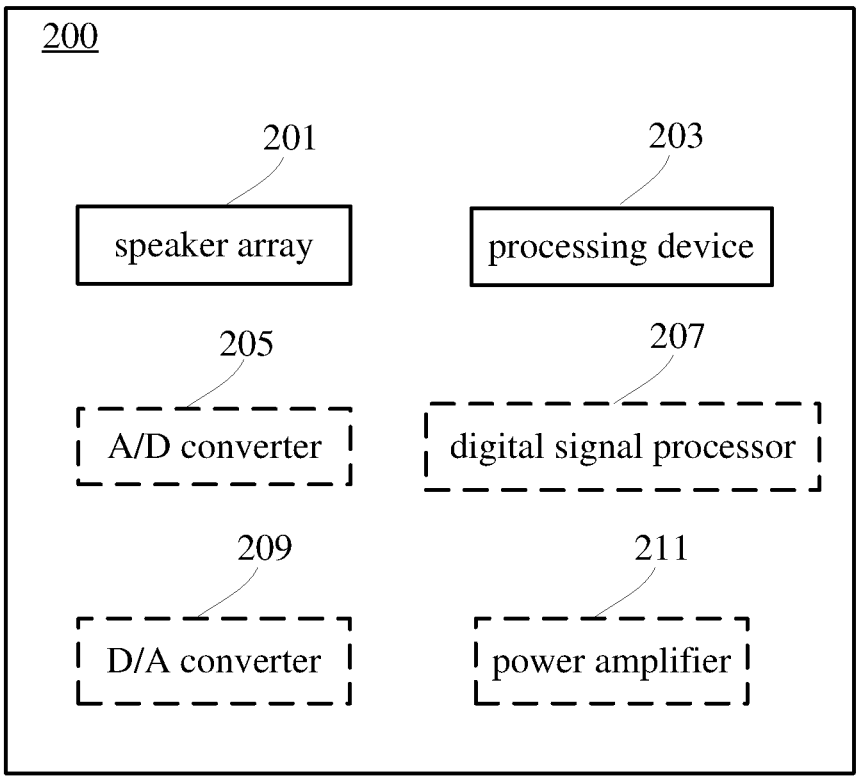
FIG. 13 is a block diagram of an acoustic radiation control system according to an embodiment.

Accordingly, in an embodiment, an acoustic radiation control system is provided. Referring to FIG. 13, the acoustic radiation control system 200 includes: a speaker array 201; and a processing device 203, configured to obtain transfer functions of speakers in the speaker array 201 based on configuration of the speaker array 201 and directivity of the speakers; obtain, based on the transfer functions of the speakers, source strength of the speakers which enables acoustic radiation of the speaker array 201 in a first zone greater than acoustic radiation of the speaker array 201 in a second zone; and apply the source strength of the speakers to the speaker array 201.

In some embodiments, the configuration of the speaker array 201 may include a number of the speakers in the speaker array 201, a facing direction of the speakers in the speaker array 201 and spacing between adjacent speakers in the speaker array 201.

In some embodiments, the processing device 203 may be configured to: calculate an original transfer function of each speaker in the speaker array 201; measure directivity of each speaker in the speaker array 201, wherein the directivity of the speaker represents acoustic radiation of the speaker at different optimized positions; and obtain a product of the original transfer function and the directivity of each speaker as the transfer functions of the speakers.

In some embodiments, the processing device 203 may be configured to determine the original transfer functions of the speakers and the directivity of the speakers based on the configuration of the speaker array 201.

In some embodiments, the processing device 203 may be configured to determine the original transfer functions of the speakers and the directivity of the speakers further based on frequency of an input audio source provided to the speaker array 201.

In some embodiments, the processing device 203 may be configured to calculate the transfer function of each speaker in the speaker array 201 based on Equation (1), $$H_D(r_n) = \frac{e^{-jk|r|}}{|r|} D(\theta, k), \qquad \text{Equation (1)}$$

where $$\frac{e^{-jk|r|}}{|r|}$$

is an original transfer function of the $n^{th}$ speaker in the speaker array 201, $D(\theta,k)$ is the directivity of the $n^{th}$ speaker at wave number k, $k=2\pi f/c$, f is frequency of an input audio source, c is speed of sound, r is a vector representing a position relation between an optimized position and a center of the $n^{th}$ speaker, and θ is an angle between a direction from a center of the $n^{th}$ speaker to the optimized position and a facing direction of the $n^{th}$ speaker.

Optionally, in some embodiments, the processing device 203 may be configured to obtain the transfer functions of the speakers in the speaker array 201 based on an anechoic chamber test.

In some embodiments, the source strength of the speakers obtained by the processing device 203 based on the transfer functions of the speakers may maximize a ratio of acoustic radiation of the speaker array 201 in the first zone to acoustic radiation of the speaker array 201 in the second zone.

In some embodiments, the processing device 203 may be configured to obtain the source strength of the speakers using an acoustic contrast control method based on the transfer functions of the speakers.

In some embodiments, the processing device 203 may be configured to perform the inverse Fourier transform to the source strength of the speakers to obtain coefficients of a FIR filter.

In some embodiments, the processing device 203 may be a CPU, a MCU, or a DSP etc., or any combination thereof.

In some embodiments, if the input audio source is an analog signal, the acoustic radiation control system 200 may further include: an A/D converter 205 configured to convert the input audio source to digital signals; a digital signal processor 207 configured to process the digital signals output from the A/D converter 205, wherein the FIR filter is applied on the digital signal processor 207 to filter the processed digital signals; a D/A converter 209 configured to convert the filtered signals into analog signals; and a power amplifier 211 configured to amplify the analog signals output from the D/A converter 209 to form analog voltages to be applied to the speakers.

In some embodiments, if the input audio source is digital signals (for example, input through fiber optic or High Definition Multimedia Interface (HDMI)), the A/D converter 205 may be replaced by a decoder.

Components of the acoustic radiation control system are not limited to the embodiment.

In some embodiments, the A/D converter 205, the digital signal processor 207, the D/A converter 209 and the power amplifier 211 may be included in the processing device 203.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. An acoustic radiation control method, comprising:

configuring a speaker array;

obtaining transfer functions of speakers in the speaker array based on a configuration of the speaker array and a measured directivity of the speakers, comprising the steps of:

calculating an original transfer function of each speaker in the speaker array;

measuring a directivity of each speaker in the speaker array, the measured directivity of each speaker in the speaker array represents an acoustic radiation of the speaker at different optimized positions; and taking a product of the original transfer function and the directivity of each speaker in the speaker array;

obtaining, based on the transfer functions of the speakers, a source strength of the speakers which enables an acoustic radiation of the speaker array in a first zone greater than an acoustic radiation of the speaker array in a second zone; and applying the source strength of the speakers to the speaker array.

2. The acoustic radiation control method according to claim 1, wherein the configuration of the speaker array comprises a number of the speakers in the speaker array, a facing direction of the speakers in the speaker array and a spacing between adjacent speakers in the speaker array.

3. The acoustic radiation control method according to claim 1, wherein the original transfer functions of the speakers in the speaker array are determined based on the configuration of the speaker array and the directivity of the speakers in the speaker array is are determined based on the configuration of the speaker array.

4. The acoustic radiation control method according to claim 3, wherein the original transfer functions of the speakers and the directivity of the speakers are determined further based on frequency of an input audio source provided to the speaker array.

5. The acoustic radiation control method according to claim 4, wherein the transfer function of each speaker in the speaker array is calculated based on Equation (1), $$H_D(r_n) = \frac{e^{-jk|r|}}{|r|} D(\theta, k), \qquad \text{Equation (1)}$$

where $$\frac{e^{-jk|r|}}{|r|}$$

is an original transfer function of the $n^{th}$ speaker in the speaker array, D(θ, k) is the directivity of the $n^{th}$ speaker at wave number k, k=2πf/c, f is frequency of an input audio source, c is speed of sound, r is a vector representing a position relation between an optimized position and a center of the $n^{th}$ speaker, and θ is an angle between a direction from a center of the $n^{th}$ speaker to the optimized position and a facing direction of the $n^{th}$ speaker.

6. The acoustic radiation control method according to claim 1, wherein the source strength of the speakers obtained based on the transfer functions of the speakers maximizes a ratio of an acoustic radiation of the speaker array in the first zone to an acoustic radiation of the speaker array in the second zone.

7. The acoustic radiation control method according to claim 6, wherein the source strength of the speakers is obtained using an acoustic contrast control method based on the transfer functions of the speakers.

8. The acoustic radiation control method according to claim 1, wherein applying the source strength of the speakers to the speaker array comprises:

performing the inverse Fourier transform to the source strength of the speakers to obtain coefficients of a Finite Impulse Response (FIR) filter, wherein the FIR filter is applied to an input audio source provided to the speaker array.

9. An acoustic radiation control system, comprising:

a speaker array; and a processor configured to:

obtain transfer functions of speakers in the speaker array based on a configuration of the speaker array and a directivity of the speakers, comprising the steps of:

calculating an original transfer function of each speaker in the speaker array;

measuring a directivity of each speaker in the speaker array, the measured directivity of each speaker in the speaker array represents an acoustic radiation of the speaker at different optimized positions; and taking a product of the original transfer function and the directivity of each speaker in the speaker array;

obtain, based on the transfer functions of the speakers, a source strength of the speakers which enables an acoustic radiation of the speaker array in a first zone greater than an acoustic radiation of the speaker array in a second zone; and apply the source strength of the speakers to the speaker array.

10. The acoustic radiation control system according to claim 9, wherein the configuration of the speaker array comprises a number of the speakers in the speaker array, a facing direction of the speakers in the speaker array and a spacing between adjacent speakers in the speaker array.

11. The acoustic radiation control system according to claim 9, wherein the processor is configured to determine the original transfer functions of each of the speakers based on the configuration of the speaker array and the directivity of each of the speakers based on the configuration of the speaker array.

12. The acoustic radiation control system according to claim 11, wherein the processor is configured to determine the original transfer functions of the speakers and the directivity of the speakers is further based on a frequency of an input audio source provided to the speaker array.

13. The acoustic radiation control system according to claim 12, wherein the processor is configured to calculate the transfer function of each speaker in the speaker array based on Equation (1), $$H_D(r_n) = \frac{e^{-jk|r|}}{|r|} D(\theta, k), \qquad \text{Equation (1)}$$

where $$\frac{e^{-jk|r|}}{|r|}$$

is an original transfer function of the $n^{th}$ speaker in the speaker array, D(θ, k) is the directivity of the $n^{th}$ speaker at wave number k, k=2πf/c, f is frequency of an input audio source, c is speed of sound, r is a vector representing a position relation between an optimized position and a center of the $n^{th}$ speaker, and θ is an angle between a direction from a center of the $n^{th}$ speaker to the optimized position and a facing direction of the $n^{th}$ speaker.

14. The acoustic radiation control system according to claim 9, wherein the source strength of the speakers obtained by the processor based on the transfer functions of the speakers maximizes a ratio of an acoustic radiation of the speaker array in the first zone to an acoustic radiation of the speaker array in the second zone.

15. The acoustic radiation control system according to claim 14, wherein the processor is configured to obtain the source strength of the speakers using an acoustic contrast control method based on the transfer functions of the speakers.

16. The acoustic radiation control system according to claim 9, wherein the processor is configured to perform the inverse Fourier transform to the source strength of the speakers to obtain coefficients of a Finite Impulse Response (FIR) filter, wherein the FIR filter is applied to an input audio source provided to the speaker array.

* * * * *